US007337935B1

(12) United States Patent
Glanville

(10) Patent No.: US 7,337,935 B1
(45) Date of Patent: Mar. 4, 2008

(54) GOLF BAG COUPLING SYSTEM

(76) Inventor: James J. Glanville, 8770 E. Yale Ave., Unit B, Denver, CO (US) 80231

( * ) Notice: Subject to any disclaimer, the term of this patent is extended or adjusted under 35 U.S.C. 154(b) by 717 days.

(21) Appl. No.: 10/863,982

(22) Filed: Jun. 8, 2004

Related U.S. Application Data

(60) Provisional application No. 60/533,313, filed on Dec. 29, 2003, provisional application No. 60/477,373, filed on Jun. 9, 2003.

(51) Int. Cl.
*A45F 3/00* (2006.01)
*A45F 3/04* (2006.01)
*A45F 3/08* (2006.01)

(52) U.S. Cl. ..... 224/628; 224/632; 224/629; 224/641; 224/262

(58) Field of Classification Search ..... 224/628, 224/262, 647, 260, 918, 629, 632, 641
See application file for complete search history.

(56) References Cited

U.S. PATENT DOCUMENTS 1,601,624 A * 9/1926 Houghton ..... 224/195
5,038,984 A 8/1991 Izzo
5,042,703 A 8/1991 Izzo
5,042,704 A 8/1991 Izzo
5,067,643 A * 11/1991 McKinney ..... 224/197
5,419,473 A * 5/1995 Lamar ..... 224/632
5,558,259 A 9/1996 Izzo
5,593,077 A 1/1997 Izzo
5,950,889 A * 9/1999 Feldman, Jr. ..... 224/259
5,954,250 A * 9/1999 Hall et al. ..... 224/262
D415,351 S 10/1999 Wang
5,996,871 A 12/1999 Maeng
6,182,874 B1 * 2/2001 Feldman, Jr. ..... 224/259
6,460,747 B1 10/2002 Tuerschmann et al.
6,471,105 B1 10/2002 Ammerman et al.

OTHER PUBLICATIONS

Yahoo search relating to golf bags, Feb. 13, 2003.

* cited by examiner

*Primary Examiner*—Nathan J. Newhouse
*Assistant Examiner*—Lester L. Vanterpool
(74) *Attorney, Agent, or Firm*—Townsend and Townsend and Crew LLP

(57) ABSTRACT

A golf bag harness is provided comprising a main support member, a belt system coupled with the main support member for securing a golf bag to the waist and shoulders of a wearer, and a coupling system for coupling the main support member with the golf bag. A slotted configuration can be provided according to one embodiment of the invention for providing adjustability in the positioning of the golf bag on a wearer's back. The slotted arrangement can be configured to provide adjustability in a horizontal and/or vertical position.

4 Claims, 10 Drawing Sheets

GOLF BAG COUPLING SYSTEM

CROSS-REFERENCES TO RELATED APPLICATIONS

This application claims the benefit under 35 USC §119(e) of U.S. Patent Application No. 60/477,373, filed on Jun. 9, 2003 entitled "Golf Bag Harness" as well as the benefit under 35 USC §119(e) of U.S. Patent Application No. 60/533,313, filed Dec. 29, 2003, entitled "Golf Bag Coupling System" and hereby incorporates by reference the content of both applications in their entirety and for all purposes.

STATEMENT AS TO RIGHTS TO INVENTIONS MADE UNDER FEDERALLY SPONSORED RESEARCH OR DEVELOPMENT

Not Applicable

REFERENCE TO A "SEQUENCE LISTING," A TABLE, OR A COMPUTER PROGRAM LISTING APPENDIX SUBMITTED ON A COMPACT DISK

Not Applicable

Some embodiments of this invention relate generally to coupling systems. For example, some embodiments relate to golf bag coupling systems.

BACKGROUND

The goal of playing golf is to complete play on eighteen holes with a minimum number of strokes. The success of such an endeavor is mostly dependent on a person's physical fitness. The dichotomy is that in order to play golf most participants desire to carry the necessary equipment—which degrades that which is required for success, physical fitness. In other words, the weight of a fully loaded golf bag that must be carried for eighteen holes of golf can cause short term physical problems as well as long term back problems, such as a deterioration of the skeletal system, particularly in the spinal area. The degree of deterioration can limit (if not prevent) a person's ability of carry their own golf equipment. Being able to carry one's own golf equipment usually is more preferable to riding a golf cart or using a pull cart.

Furthermore, there is a social impact to not being able to carry one's own golf bag. Some people feel left out if they are the only one in a golf group required to rent a riding cart because they are unable to carry their golf clubs. They are not able to join the other players in social conversation in between golf strokes, since carts are typically limited to paved paths while those who carry their clubs walk along the fairway, for example. Therefore, those who are required to use carts may instead just defer from playing in such groups. As a result, they will be left out of such social settings.

Even for those who have good physical fitness with no apparent back problems, carrying a bag on one's shoulders can produce fatigue over a round of golf. As a result, one's ability to play the game of golf—which requires a smooth and reliable stroke—can be hindered in the latter holes of a round of golf due to fatigue. Such fatigue can also affect caddies who often carry two bags during a round of golf. This can be a very tiring experience and thus limit the number of rounds of golf that a caddie can work during a day.

As a result, there is a need for a golf bag carrying system which provides reduced stress on one's back. Similarly, it would be desirable for there to be a golf bag harness that facilitates ease in carrying the necessary golf equipment throughout a round of golf.

SUMMARY

One embodiment of the invention provides a golf bag harness comprised of three basic parts: a main support member with a means for coupling the main support member to a golf bag either internally or externally; a waist belt coupled with the main support member for securing around the waist of the user and two shoulder straps coupled with the main support member for securing lateral movement of the harness on the user.

Another embodiment of the invention provides adjustment of the mounting of the golf bag to the harness which allows the wearer of the golf bag to adjust the height and lateral position of the golf bag on the wearer's back for comfort and use.

Another embodiment of the invention provides a harness which can be lightweight so as to not add any additional weight to that which the user has to carry.

Further embodiments of the invention will be apparent to those of ordinary skill in the art from a consideration of the following description taken in conjunction with the accompanying drawings, wherein certain methods and apparatuses for practicing the embodiments of the invention are illustrated. However, it is to be understood that the invention is not limited to the specific embodiments discussed, but includes all variations and modifications that fall within the spirit of the invention.

DESCRIPTION

Figure 1A:
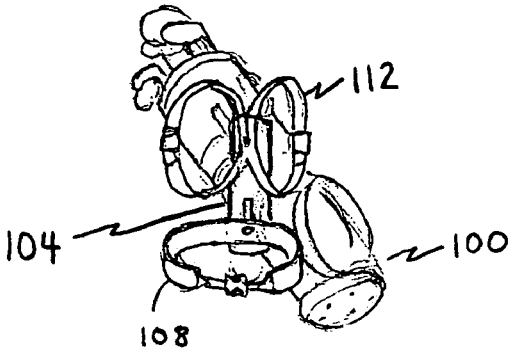
FIG. 1A illustrates a golf bag harness integrally attached to a new golf bag according to one embodiment of the invention.

FIG. 1A illustrates a first embodiment of the invention. In FIG. 1A, a golf bag 100 is shown coupled to a golf bag harness. The golf bag harness can be comprised of a light weight main support member or panel 104, a padded waist belt 108, and two shoulder straps 112. A slot can be located in the support member for adjusting the position of the bag, e.g. height, on the wearer's back. For newly manufactured golf bags, the harness could be integrally attached to the golf bag support structure. For coupling with an existing golf bag, a variety of coupling systems can be used to couple a golf bag with the main support member.

According to one embodiment of the invention, the main support member could be made of a strong lightweight material such as plastic, fiberglass, etc. with a slight curvature to approximate the curvature of a person's spine. As can be seen in the side view in FIG. 13, that exemplary main support member is configured so as to seat against the curvature of a person's back. The slight curvature in the lumbar region of a person's spine facilitates carrying a weight on the user's waist. A slight angle to the main support member angling away from the user's shoulders further allows the weight to be transferred to and carried on the user's waist, rather than on the user's shoulders.

Figure 14:
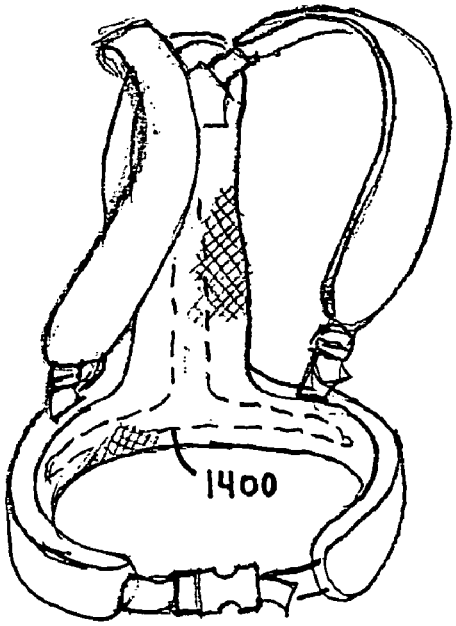
FIG. 14 illustrates a golf bag harness according to one embodiment of the invention.
Figure 15:
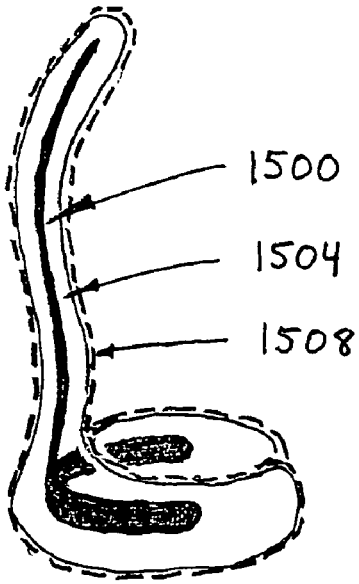
FIG. 15 illustrates an example of a support member, according to one embodiment of the invention.

FIGS. 14 and 15 further illustrate examples of implementations of a main support member. In FIG. 14, a main support member 1400 is shown as part of a golf bag harness covered with padding. The main support member is shown with a vertical support portion configured to conform substantially with a user's spine and a waist portions that are configured to extend partially around the user's waist when the harness is being worn. Similarly, FIG. 5 illustrates a lightweight metal skeletal support member 1500 which is shown encased in molded rubber, urethane, or similar type material 1504. It is also shown with a net fabric cover to provide additional comfort for the user. The version in FIG. 15 lends itself to mass production in that the waist belt could be manufactured from the encasing material by tapering the thickness of the material until it became flexible enough to facilitate coupling about a user's waist.

The design of the main support member is intended to transfer the weight of the golf bag being carried to a user's waist area as opposed to the user's shoulders. The unitary construction of the main support member allows this transfer of force from the point at which the golf bag is coupled to the main support member to the waist portions of the main support member. This also spreads the force from the bag along the waist portion of the main support member so as not to overstress one portion of the user's body—as typically occurs with a bag carried over one's shoulder. This also allows the user to walk upright rather than forcing the user to lean forward or to one side to counteract the weight of the bag. Thus, it facilitates good posture which further protects the health of the user's back and spine. It should be understood that use of the term member can include a structural support or panel, such as a bar or rod. Furthermore, use of the term member is not intended to require that the structure be inflexible.

According to another embodiment of the invention a vertical slot could be configured in the main support member, such as in the middle of the main support member. This slot could be used to couple the golf bag with the harness. Therefore, a member coupled to the golf bag, such as a pin, could be inserted through the slot so as to guide the golf bag up and down the slot in a vertical manner. Thus a user need only choose the appropriate vertical height by use of the slot and pin combination. A locking mechanism could be used to lock the pin in the selected position along the slot of the main support member, as would be readily understood by those of ordinary skill in the art.

Figure 13:
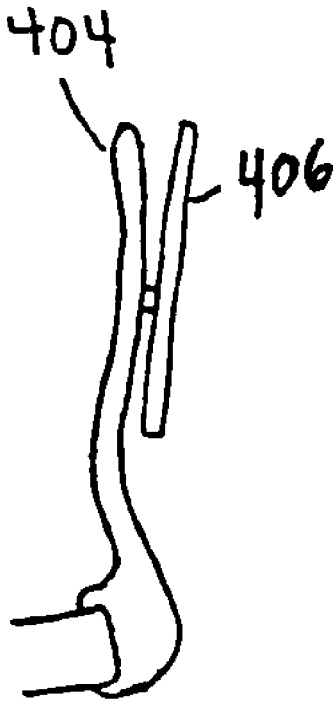
FIG. 13 illustrates a side view of a golf bag harness that utilizes an additional plate coupled with a main support member, according to one embodiment of the invention.

Furthermore, as shown in FIG. 13, a separate member could be coupled with the main support member for use as the height adjustment member. Thus, in FIG. 13, the slot could alternatively be placed in plate 406 shown coupled with the main support 404. Thus, rather than putting the slot as part of the main support member, the slot could be located in a member coupled with the main support member.

Figure 1B:
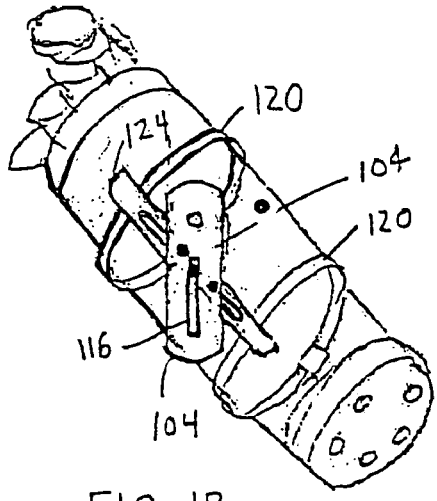
FIG. 1B illustrates the adjustability for positioning the golf bag on a golf bag harness similar to that of FIG. 1A without the shoulder straps or waist belt shown and configured for coupling the harness to an existing golf bag, according to one embodiment of the invention.

FIG. 1B shows an example of a main support member having a slot 116 coupled with a golf bag. The main support member is shown with the waist belt and shoulder straps removed for clarity. A substantially vertical slot is shown through which a member such as a pin is inserted to allow the golf bag to ride in a substantially vertical up and down manner along the wearer's back when being adjusted. Thus, the user can select the appropriate height on his or her back and lock the bag in a selected vertical position. According to one embodiment of the invention, the bag would still be free to rotate in this position to allow the user to angle the bag and prevent the bag from hitting his or her legs when walking with the bag on his or her back. For example, the user could angle the bag in a substantially transverse position relative to the user's spine so as to allow the bag to be carried without bumping into the legs of the user. The bag could be held in this position while the user walks or locked in this position with a releasable locking device.

The bottom of the main support member could be extended out a few inches on each side where the support member would come into contact with the person's lower back above the hips. This contact area could be padded as well, making the bag fit more comfortably and ergonomically on a user. A sleeve could be located on the back portion of the support member to allow a waist belt to be extended through the sleeve and thereby coupled with the support member. Alternatively, other attachment mechanisms could be used, such as sewing the waist belt straps to the different sides of the main support member. Thus, when worn by the user, the belt could be comprised of two straps that could extend from the support member in back of the wearer around both sides of the waist and connect in front such as with a quick release buckle. The belt could be approximately three inches wide having padded portions, according to one embodiment. The padded portions could be produced from the same material as conventional padded golf bag straps. The belt could also have a strap on both sides of its front end at its buckle device with enough length to allow adjustment to suit a person's waist.

According to one embodiment of the invention, the main support member and the waist belt can be configured so that the weight of the golf bag is distributed around the person's waist and is supported substantially by the person's hips and lower portion of the body. In this embodiment, the shoulder straps would not carry any significant weight but would primarily be used for the purpose of laterally securing the harness and golf bag to the user's back. Furthermore, the shoulder straps could be used to keep the harness against the users' back so as to facilitate proper fit of the harness to the user's spine and thus proper transfer of the weight of the bag to the waist area of the user via the harness.

As shown in FIG. 1A, shoulder straps can be coupled with the main support member. Padded shoulder straps can be connected to the top of the support member on both the left and right sides. The straps could measure approximately three inches wide and feature adjustable lengths, for example. They could be looped to slide easily on and off an individual's shoulders when donning the golf bag. Preferably, these straps are used to provide horizontal stability for the golf bag on a person's back once the harness is in place. It is preferable that the full weight of the golf bag rest on the shoulders for a negligible amount of time, such as when donning the golf bag so as to connect the waist belt. Once the waist belt is connected around the user's waist, it is preferable that the shoulders carry a negligible amount of weight, if any, and that the remainder be carried about the user's waist area.

In FIG. 1B, a golf bag harness for coupling with an existing golf bag is shown. This golf bag harness is comprised of loops 120 configured from straps for coupling along the longitudinal end portions of the golf bag. These loops are strapped around the golf bag so as to secure a member 124 which is disposed along the longitudinal axis of the golf bag. This member can be made of sufficient width and curvature so as to couple to the shape of the golf bag. The member can also be configured for coupling with the main support member 104. For example, a slot 116 in main support member 104 can be used to couple the longitudinal member 124 via an additional member, such as a rod or a pin. The pin, for example, can be fixed to the longitudinal member 124 for insertion through the slot of the main support member 104. Alternatively, the pin can reside in a second slot disposed in the longitudinal member. This would permit not only vertical movement of the golf bag when it is coupled with the main support member via the main support member slot; but also, it would permit lateral movement (as well as vertical movement) along the slot in the longitudinal member. The pin, once disposed in a desired position along a slot, could be locked in place via any common locking mechanism, such as a wing nut or a large circumference clamping nut commonly used in golf equipment.

Figure 3:
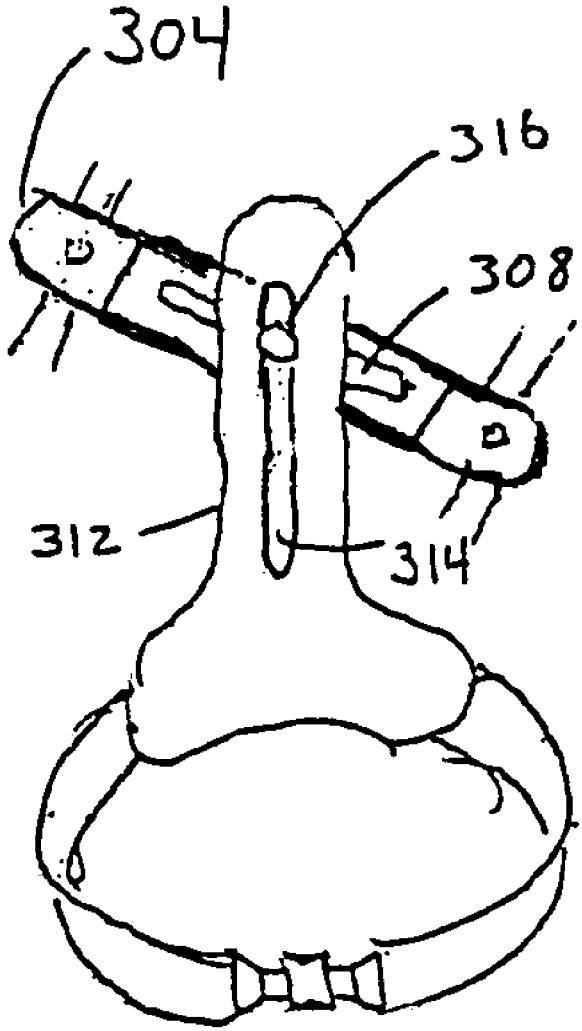
FIG. 3 illustrates an alternative golf bag harness, according to one embodiment of the invention.

FIG. 3 illustrates a further embodiment of the invention. Namely, FIG. 3 illustrates a variation of a golf bag coupling system. In FIG. 3, a member 304 having a slot 308 is coupled with the main support member 312 having a pin 316 coupled with the main support member. This pin 316 is inserted through a slot 314 in main support member 312 and a slot 308 in member 304. Thus, if the slotted member 304 is coupled with a golf bag via straps for example, the golf bag and main support member can be adjusted relative to one another via the slot and pin configuration. For example, FIG. 3 can be understood to show a slotted member 304 coupled with a golf bag. The main support member 312 is coupled with the bag via the slots and pin coupling system. One can move the main support member along the slot 308 to adjust the lateral and vertical position of the bag on the user's back. According to one embodiment of the invention the bag can also swivel via the pin. Thus, in addition to being able to adjust the lateral and vertical position of the bag via the slots and pin combination, one can also rotate the bag via the pin. Normally, the pin would be configured in a cylindrical manner to facilitate such rotation.

While the pin and slot configurations have been described as extending a pin or rod through the slot, it should also be understood to cover configurations in which a pin or rod extends partially through a slot. For example, some pin and slot arrangements are configured so that the pin runs within a groove of the slot without extending completely through the slot.

Figure 2A:
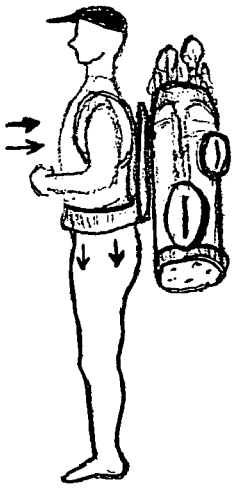
FIG. 2*a* illustrates a golf bag harness according to one embodiment of the invention with the golf bag adjusted in a transverse position relative to the back of the user.

To use the golf bag harness according to one embodiment of the invention, the user would first couple the golf bag harness to the golf bag if the harness is the type to be used with an existing golf bag. Alternatively, if the golf bag harness is integral to the golf bag then this act would not be required. The user would then slip a shoulder strap over one shoulder to momentarily support the bag on the shoulder while the other strap is slipped over the other shoulder. The waist belt could then be strapped around the waist of the user so as to secure the golf bag around the waist. FIG. 2A shows such a positioning. The wearer in FIG. 2A is supporting the weight of the golf bag primarily on his waist, via the waist belt and main support member. The main support member is configured with a curvature to substantially conform to the lower back for additional comfort. Furthermore, by virtue of the weight being supported at the waist, the shoulders incur a very light load (if any at all) as compared to a shoulder carried bag. The waist belt can be adjusted by pulling the straps at the buckle for a firm, but comfortable, fit around the waist. The adjustment procedure would only need to be performed when the bag is first donned. The bag and harness could be removed by disconnecting the quick release buckle and slipping the straps off the shoulders. As the bag is placed on the ground, a kickstand would (if provided as part of the golf bag) automatically kick out to keep the bag in an upright position. The harness could be attached to the bag so as not to interfere with the golf bag's stand.

Figure 2B:
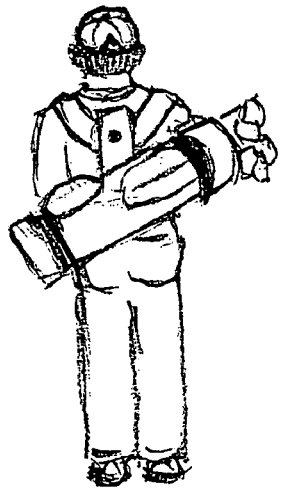
FIG. 2*b* illustrates a rear view of the golfer in FIG. 2*a* further illustrating the transverse position of the bag while the bag is being carried by a user, according to one embodiment of the invention.

Once the harness is positioned on the user's back, the bag can be located in a desired position according to the described embodiments of the invention. For example, a wearer can determine whether the bag is positioned comfortably on his back. If not, an assistant can release the locking mechanism and slide the golf bag along the slot to a new position and lock the golf bag in place. This adjustment procedure can be repeated until the desired location is determined for the golf bag. As explained earlier, a variety of slot configurations can be used to allow the golf bag to be moved vertically along a slot or moved horizontally along a slot. Furthermore, a transverse slot can be used such as that shown in FIG. 3 to allow both horizontal and vertical positioning. Furthermore, when a golf bag coupler is used that permits rotation of the bag relative to the user's back, the golf bag can be rotated to a transverse position. This facilitates walking with the bag in that the bag is less likely to bump into the user's legs when walking. FIG. 2B illustrates a rear view of a user carrying a golf bag positioned in a substantially transverse position.

To configure the set up of the bag by oneself, the bag can be removed and positioned along a height adjustment support member and then donned again. Through repeated fittings the proper slot positioning can be selected. Thus, the user can remove the bag and select the proper position along the height adjustment support member for wearing the bag during a round of golf. Once the bag is configured and locked into place, it is unlikely that it will need to be modified very often.

Figure 4A:
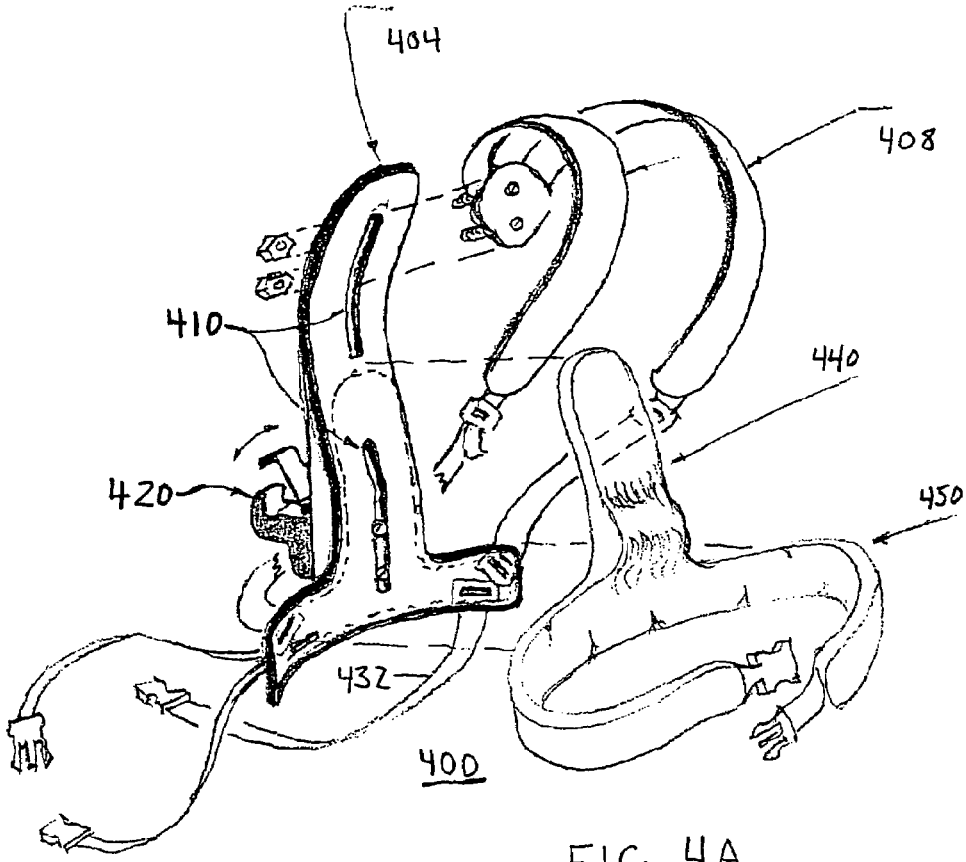
FIG. 4A illustrates an exploded view of a golf bag harness, according to one embodiment of the invention.

Referring now to FIG. 4A, another embodiment of the invention can be seen. FIG. 4A illustrates an exploded view of a golf bag harness 400. Golf bag harness 400 is shown comprised of a main support member, which is typically a solid mounting plate 404. The mounting plate 404 has adjustment slots for coupling shoulder straps 408 and a golf bag coupler, such as golf bag clamp 420, respectively. The shoulder straps 408 are shown as having a mounting bracket which can be inserted through the upper slot and retained by retaining nuts. Furthermore, they can be positioned along the slot so as to adjust the fit of the harness to the golfer.

A back padding 440 is shown for coupling with the mounting plate 404. The dashed outline on mounting plate 404 illustrates where back padding 440 can be positioned. A padded waist belt 450 is also shown integral with the back padding. The back padding 440 can be coupled with the mounting plate 404 in a variety of ways, such as stitching, hook and loop material, adhesive, etc. Shoulder straps 408 can couple with the lower arms of the mounting plate 404 which are configured to extend partially around the waist of the user.

FIG. 4A illustrates that a golf bag handle clamp 420 can be coupled with the rear portion of the mounting plate 404. The golf bag handle clamp is coupled with the golf bag harness through use of the lower adjustment slot 410 in FIG. 4A. This slot allows the golf bag handle coupler to be positioned at a comfortable height on the user's back. Furthermore, if the golf bag coupler can rotate, it allows the bag to be positioned in a substantially transverse position relative to the user's spine so as to keep the golf bag from hitting the legs of the person wearing the harness.

To couple the golf bag with the harness in FIG. 4A, the golf bag handle is inserted into the clamp and the clamping jaws are closed and established in a locked position. The golf bag handle clamp allows a golfer or caddy to couple the handle on a golf bag with the harness. Typically, the handle of a golf bag is positioned by manufacturers at a place on the golf bag so that when the golf bag is carried by the handle the ordinary weight distribution of the golf bag will not cause the golf bag to tip forward and thereby cause the contents of the golf bag to spill out. In addition to the coupling of the golf bag handle with the harness, the ends of the golf bag can be coupled to the harness by way of stabilizer straps. The stabilizer straps help to reduce any swinging of the golf bag when it is being carried. For example, straps 430 and 432 can be used to encircle the golf bag to reduce any movement about the clamp. Furthermore, reducing this swing can help to prevent damage to the golf bag handle since it would help reduce any twisting of the golf bag handle material.

Figure 4B:
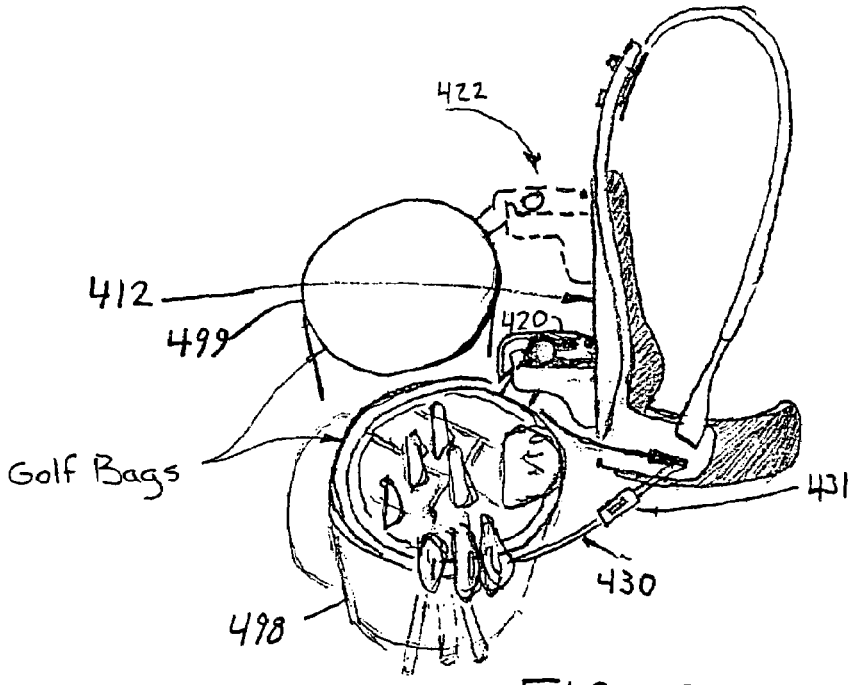
FIG. 4B illustrates a side view of the golf bag harness from FIG. 4A configured to hold two golf bags, according to one embodiment of the invention.

FIG. 4B illustrates a side view of the golf bag harness shown in FIG. 4A. FIG. 4B is shown having a mounting plate coupled with a first golf bag handle clamp 420 and a second golf bag handle clamp 422. First golf bag 498 is shown coupled with the golf bag handle clamp 420 while a second golf bag 499 is shown coupled with second golf bag handle clamp 422. This side view illustrates that the golf bag 498 is stabilized with stabilizer strap 430. The stabilizer strap shown in this embodiment encircles the golf bag originating from the right side of the harness and looping back to the harness. This allows the golf bag to be stabilized and prevents it from swinging. Furthermore, it keeps the bag from tilting downwards and spilling the golf clubs and other contents of the golf bag when the harness is worn by the user. A second stabilizer strap can be used to support the lower portion of the golf bag to further prevent the golf bag from moving. In addition, a strap coupler 431 is shown for use in providing a quick disconnect for the stabilizer strap. This embodiment also illustrates a system that allows a caddy or golfer to carry two golf bags.

The side view of the golf bag harness is shown having a solid filler coupled with the mounting plate. This filler provides a flat surface for mounting the golf bag handle clamp. This flat surface helps to affix the clamp firmly so as to prevent the clamp from being pulled off of the harness when the clamp is loaded.

Figure 4C:
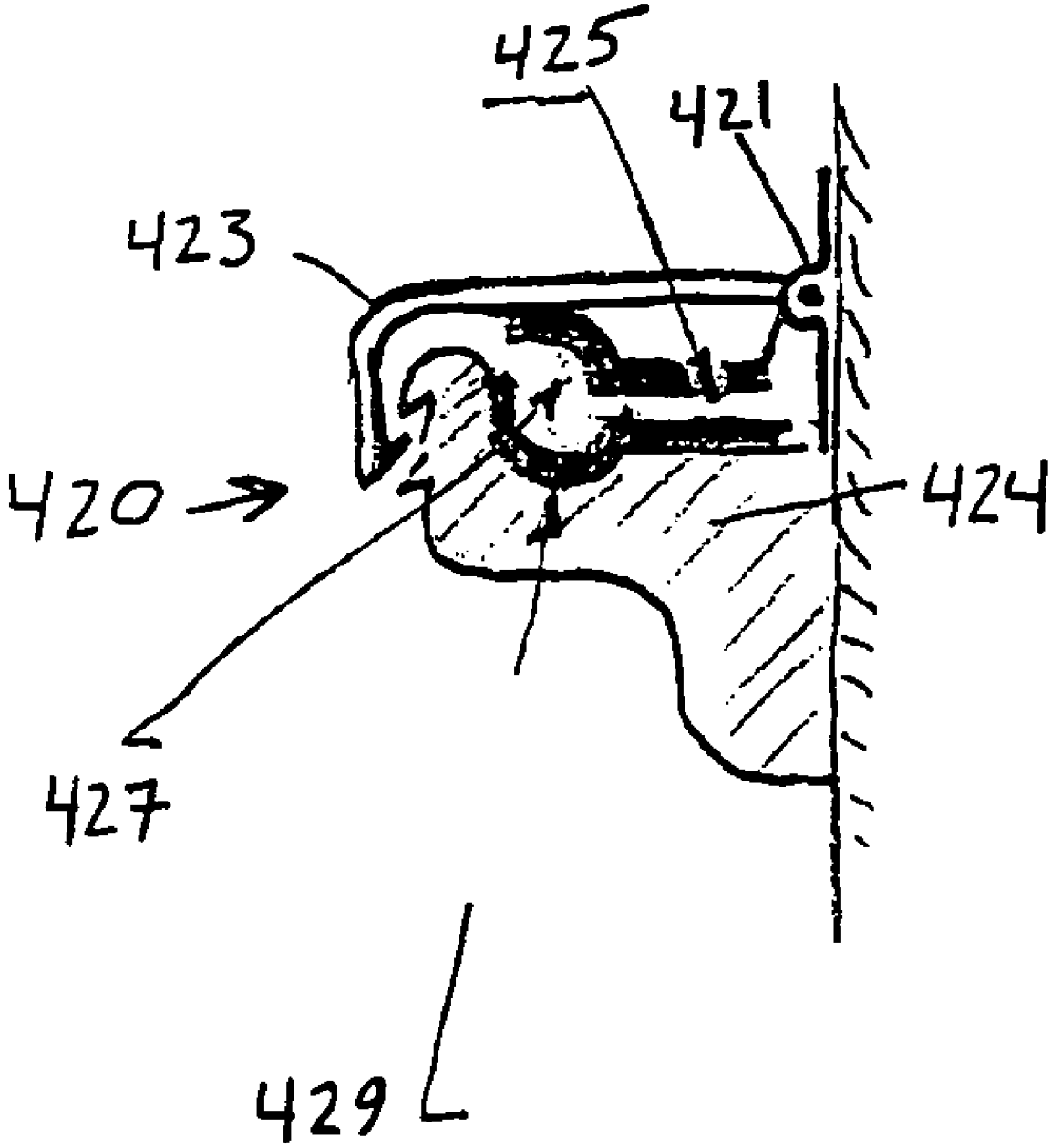
FIG. 4C illustrates a coupling system for coupling a golf bag handle with a golf bag harness, according to one embodiment of the invention.

FIG. 4C illustrates a side view of one embodiment of a golf bag handle clamp. Golf bag handles typically take one of two forms: 1) a generally circular handle; or 2) a generally flattened handle. The embodiment shown in FIG. 4C allows coupling of the clamp with either type of handle. Namely, it provides a flat handle location 425 in which the upper member 423 can be rotationally closed about hinge 421 to establish a clamp with bottom member 424. Alternatively, for a generally round handle golf bag handle, a round handle location 427 is shown. This round handle location provides a cavity for clamping golf bags with round handles. Again, the upper member 423 of the golf bag handle clamp is closed on top of the generally round golf bag handle to establish a clamp with bottom member 424. To provide a better clamping action without damaging the golf bag handle, a rubber or cleated surface 429 can be provided along the jaws of the clamp. This facilitates establishing a firm clamping grip while not damaging the golf bag handles. FIG. 4C further shows that a locking mechanism can be utilized to keep the clamp in place one it is established. FIG. 4C shows that the upper and lower members of the clamp utilize grooved ends for establishing a locking position. However, a variety of mechanisms could be utilized to establish a secure lock as would be understood by one of ordinary skill in the art.

Figure 5B:
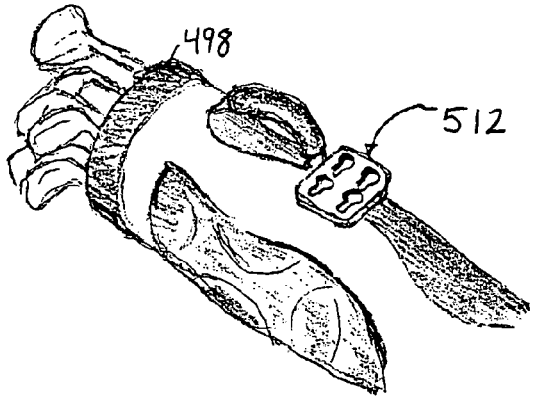
FIG. 5B illustrates a golf bag having a receiving plate for coupling a golf bag with a golf bag harness, according to one embodiment of the invention.
Figure 5A:
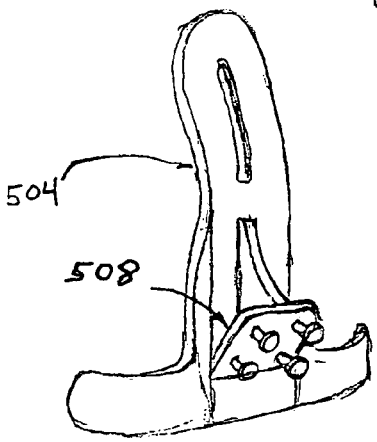
FIG. 5A illustrates a golf bag harness having a mounting plate, according to one embodiment of the invention.

Referring now to FIGS. 5A, 5B, 5C, and 5D, an alternative embodiment of the invention can be seen. These figures illustrate a golf bag coupling system for use with a golf bag having an integral mounting plate. FIG. 5B illustrates a golf bag 498 having a mounting plate positioned proximate to the golf bag handle. This mounting plate 512 is shown with four female fittings for coupling with the golf bag harness shown in FIG. 5A. The golf bag harness shown in FIG. 5A is comprised of a mounting plate 508 having four male fittings, for coupling with mounting plate 512. The harness 504 can be configured according to embodiments described herein including a height adjustment mechanism.

The mounting plate 512 and the mounting plate 508 can be coupled with one another by inserting the studs on mounting plate 508 through the holes in mounting plate 512 and sliding the golf bag into a locking position by virtue of the configuration of the slots in mounting plate 512 and the heads of the studs on mounting plate 508. The weight of the golf bag can be used to establish the locking position by forcing the studs along the slots.

Figure 5C:
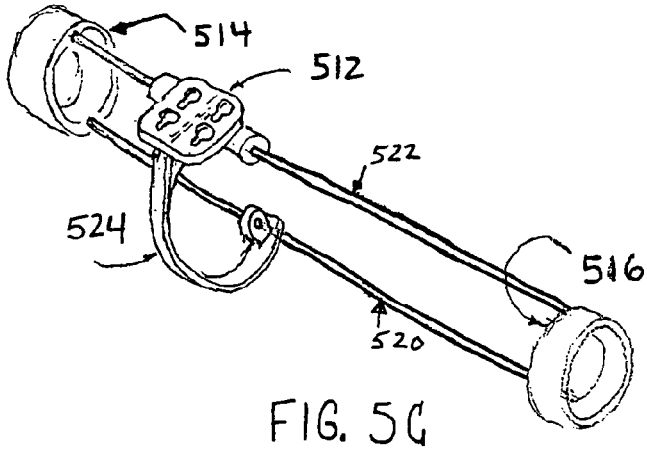
FIG. 5C illustrates a skeleton view of the internal support system for the golf bag shown in FIG. 5B, according to one embodiment of the invention.

Referring now to FIG. 5C, the internal construction of golf bag 498 according to one embodiment of the invention can be seen. In this embodiment, the golf bag is configured with a head frame 514 and foot frame 516. Golf bag support rods 522 and 520 extend between the head and foot frame to establish a support for the remainder of the golf bag. The mounting plate 512 can be positioned on golf bag support rod 522 and coupled to golf bag support rod 520 with stabilizer bar 524. Stabilizer bar 524 can take a generally curved configuration so as to provide a cavity for insertion of the golf clubs.

Figure 5D:
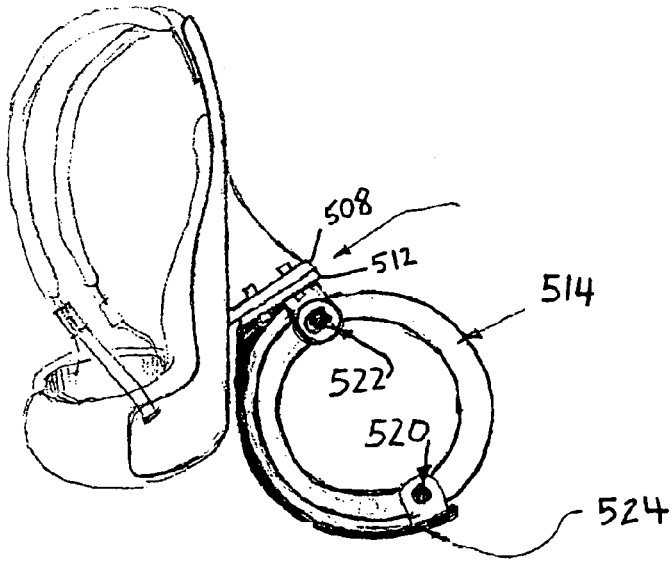
FIG. 5D illustrates a section view from the side of the golf bag harness shown in FIG. 5A coupled with the golf bag shown in FIG. 5B, according to one embodiment of the invention.

FIG. 5D illustrates a side view of the golf bag harness and a sectional view of the golf bag shown coupled with the golf bag harness. In FIG. 5D the mounting plate 508 is shown coupled with the mounting plate 512 which is integral to the golf bag. The head frame of the golf bag 514 is shown along with support rods 522 and 520. The swing stabilizer bar 524 of the golf bag is shown, as well, extending from bag support rod 522 to bag support rod 520.

The integral mounting of the mounting plate provides an alternative mounting system for the golf bag rather than requiring coupling with the golf bag handle. In some instances, it can provide a more secure coupling with the golf bag harness 504. Thus, it allows golf bags to be manufactured with a coupling system as opposed to requiring the entire coupling system to be provided as part of the golf bag harness itself.

Figure 6A:
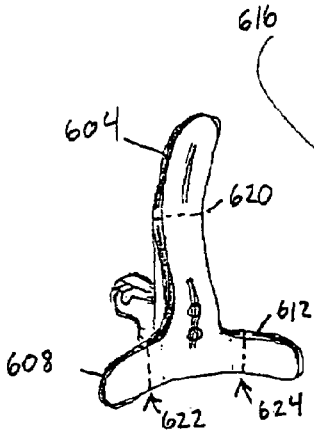
FIGS. 6A, 6B, and 6C illustrate a collapsible golf bag harness, according to one embodiment of the invention.
Figure 6B:
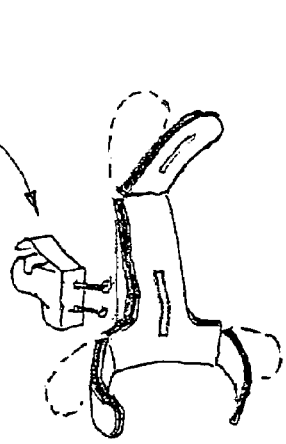
Figure 6C:
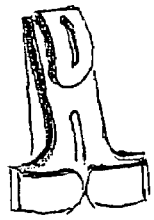

FIGS. 6A, 6B, and 6C illustrate a collapsible harness and coupling system. Essentially, the golf bag harness is shown having hinged portions which can fold onto itself. Furthermore, it is shown as having a removable coupling system that can be removed when not in use. Thus, a collapsible harness can be used to more easily store the harness in one's trunk, locker, or other storage locations between use of the harness for golfing outings.

FIG. 6A illustrates the typical use position for a collapsible golf bag harness according to one embodiment of the invention. The golf bag harness is shown as having an upper frame portion 604 which is hingibly coupled with the lower frame portion about hinge 620. A right hip portion 608 is also shown coupled with the lower frame portion about hinge 622. Similarly, a left hip portion 612 is shown coupled with the lower portion about hinge 624. FIG. 6B illustrates that the clamping system 616 can be removed from the lower frame portion according to this embodiment. Furthermore, FIG. 6B illustrates a partial folding of the upper frame portion 604 down onto the lower frame portion, as well as folding of the hip portions onto the lower frame portion. Finally, FIG. 6C illustrates the completely collapsed harness in a storage position. As can be seen from this configuration, the harness can be folded into a low profile configuration for ease in storing in tight spaces, such as the trunk of one's car.

Figure 7:
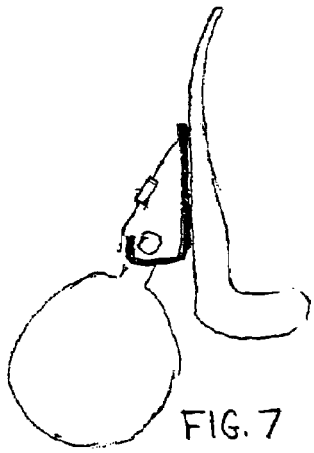
FIG. 7 illustrates a coupling system for coupling a golf bag with a golf bag harness, according to one embodiment of the invention.

FIGS. 7, 8, 9, 10, 11, and 12, illustrate alternative coupling systems. In FIG. 7, a generally J-shaped support rod is shown for use as a coupling member. The J-shaped support rod is configured so that the hook can be threaded through the golf bag handle to support the golf bag when the harness is worn. Straps coupled by a coupler can be snapped into place to prevent the golf bag handle from bouncing off of the support rod. Furthermore, additional stabilizer straps can be used to support the upper and/or lower portions of the golf bag as noted earlier.

Figure 8:
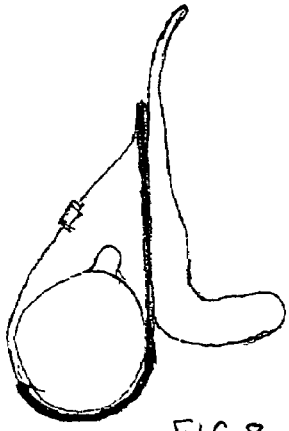
FIG. 8 illustrates another example of a coupling system for a golf bag harness, according to one embodiment of the invention.

FIG. 8 illustrates a support member which extends around the outside perimeter of the golf bag in a trough-like manner. The width of the support member can be established so as to provide sufficient support of the golf bag without damaging the golf bag. Again, a strap and coupler can be used to keep the golf bag from bouncing out of the trough.

Figure 9:
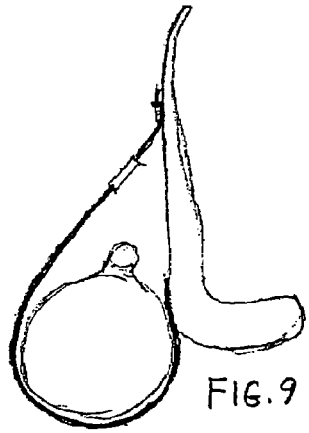
FIG. 9 illustrates yet another coupling system for a golf bag with a golf bag harness, according to one embodiment of the invention.

FIG. 9 illustrates a coupling system comprised of a strap which can extend around a golf bag to couple it with a harness worn by a user. The strap can be provided with sufficient width so as to support the golf bag without creating potentially damaging pressure points along the surface of the golf bag.

Figure 10:
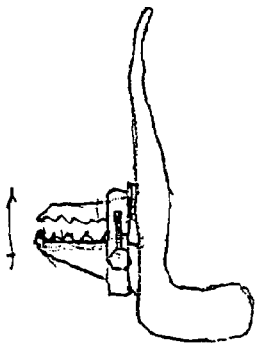
FIG. 10 illustrates a coupling system for coupling a golf bag with a golf bag harness, according to one embodiment of the invention.

FIG. 10 illustrates a side view of a clamping system according to one embodiment of the invention. FIG. 10 shows that upper and lower jaws can be vertically clamped down upon a golf bag handle. The jaws of this particular embodiment are shown having cleated areas for establishing sufficient clamping engagement with the golf bag handle.

Figure 11:
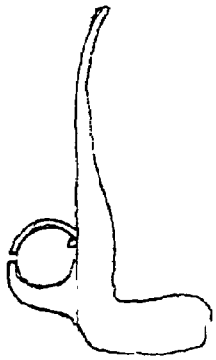
FIG. 11 illustrates a coupling system for coupling a golf bag with a golf bag harness, according to one embodiment of the invention.

FIG. 11 illustrates an embodiment of a clamping system forming a generally circular clamping surface. The jaws of the clamp according to this embodiment can be configured with a curvature so as to establish this generally circular clamping surface when in a closed position. This embodiment is particularly suited for golf bags having generally circular handles.

Figure 12:
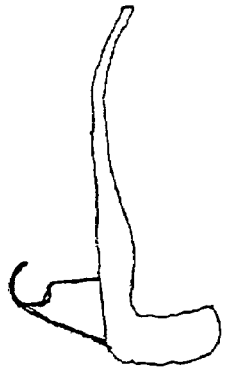
FIG. 12 illustrates a coupling system for coupling a golf bag with a golf bag harness, according to one embodiment of the invention.

FIG. 12 illustrates yet another embodiment of a coupling system. The coupling system in FIG. 12 utilizes a hook configuration having a member which extends in a curved fashion so as to encircle a substantial portion of a handle when the handle of the golf bag is placed in the trough of the hook. By extending the support member substantially about the golf bag handle, this configuration helps to prevent the golf bag from bouncing off the hook during play. Furthermore, this embodiment could be configured with straps to further prevent the golf bag from bouncing off the hook.

Each of the clamping devices described herein can be positioned along the main support member so as to comprise a height adjustment device. Thus, the main support member can be configured as a height adjustment support member to allow the golf bag coupler to be positioned at different heights along it. Alternatively, an additional member could be coupled with the main support member so as to serve as the height adjustment support member. While slotted arrangements have primarily been described herein, other coupling systems could be used as well to allow the golf bag coupler to be positioned along the height adjustment support member. For example, the slot could take the form of a series of holes which could mate with peg(s) on the golf bag coupler. Alternatively, the golf bag coupler could be configured with a groove which allows it to slide along the height adjustment support member.

As noted earlier, a variety of locking mechanisms could be used to lock the golf bag coupler in position along the height adjustment support member. These locking mechanisms can be configured to not only releasably secure the golf bag coupler at a vertical height along the height adjustment support member, but also, the locking mechanisms can be configured to allow at least partial rotation of the golf bag to a substantially transverse position, for example 45 degrees, 60 degrees, or even 90 degrees from the axis of the harness wearer's spine. They could even be configured with a stop to prevent the golf bag from accidentally rotating too far and spilling its contents on the ground. This would allow the golf bag coupler to at least partially rotate without altering the height at which the golf bag coupler is mounted along the height adjustment support member.

Figure 17:
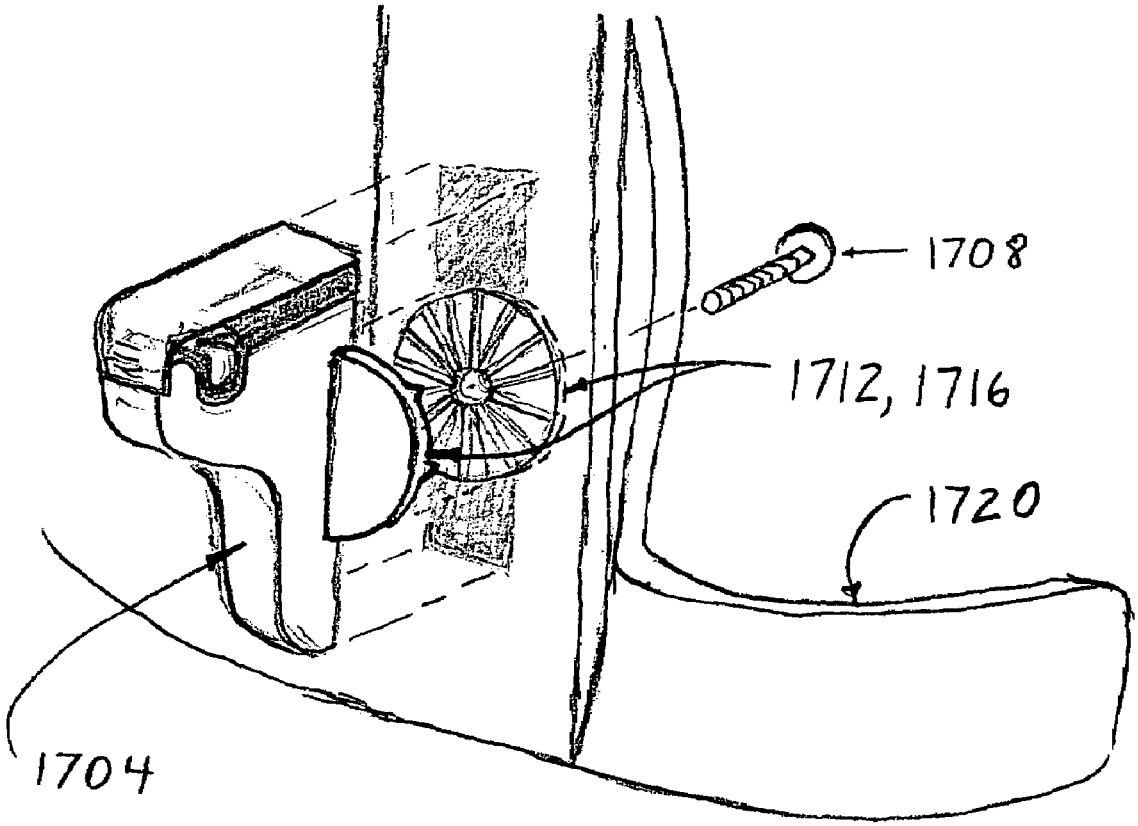
FIG. 17 illustrates an exploded view of a golf bag coupler for use in moving the position of the bag to a substantially transverse position.
Figure 18:
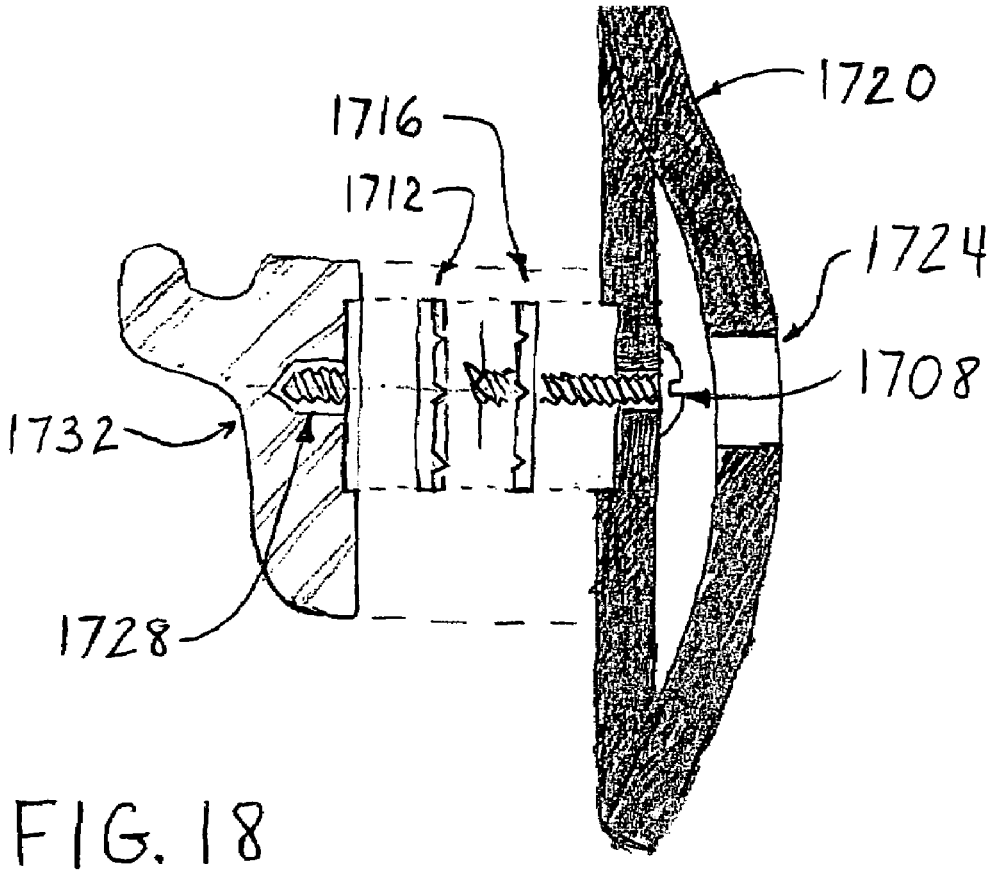
FIG. 18 illustrates cross-sectional view of the golf bag coupler shown in FIG. 17.
Figure 19:
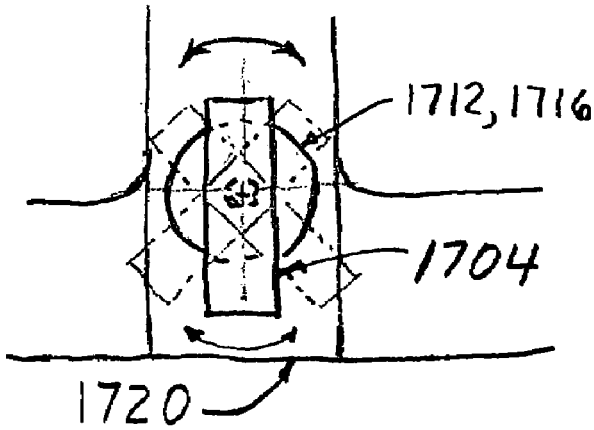
FIG. 19 illustrates a front view of the golf bag coupler shown in FIG. 17.

One example of a locking mechanism that can rotate is that shown in FIGS. 17, 18, and 19. FIG. 17 shows a bag clamp 1704. The bag clamp is coupled with a male positioning plate 1712 that can be rotated with respect to the female positioning plate 1716. Due to the plurality of grooves in the female positioning plate and corresponding ridges in the male positioning plate, the male plate can be rotated throughout different positions with respect to the female plate and still be fastened securely to the female plate. Thus, this allows the clamp to be secured in different positions. A locking screw 1708 can be used to releasably lock the male and female plates in position, thus allowing the bag clamp to be secured in position relative to the frame of the harness 1720. FIG. 18 shows this example further. It demonstrates that the locking screw 1708 can be accessed via an access screw 1724 and secured via a threaded insert 1728 in clamp 1732. Finally, FIG. 19 shows a front view of the rotatable locking mechanism shown in FIGS. 17 and 18. As can be seen by the arrows, the clamping portion can be disposed in a variety of positions other than vertical, as shown by the exemplary alternative locations shown in dashed lines. While this example is shown as having a stationary location on the frame, it could be adapted to slide along the frame, as well, as explained herein. For example, a slotted arrangement could be used as explained above.

Figure 16:
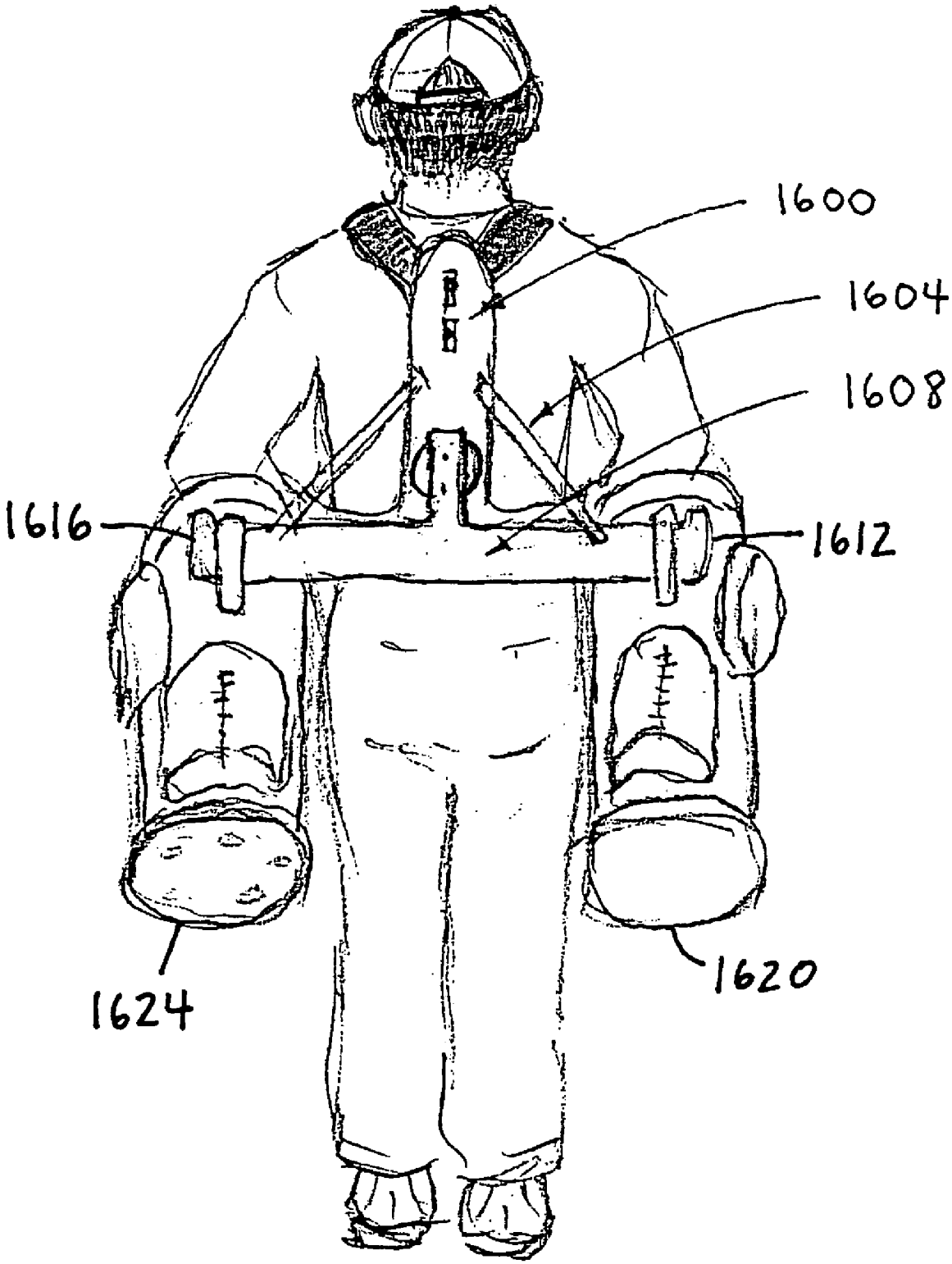
FIG. 16 illustrates an example of a dual carry golf bag harness according to another embodiment of the invention.

FIG. 16 illustrates another embodiment of the invention. Namely, FIG. 16 provides a harness for carrying two golf bags at the same time. This can be very useful for caddies who often carry two bags for their clients during a round of golf. In FIG. 16, a harness frame 1600 is shown coupled with a right side golf bag support member 1612 and a left side golf bag support member 1616. These members could be coupled separately to the harness frame or they could be configured as part of a crosspiece, such as crosspiece 1608 in FIG. 16. Support struts 1604 can be used to brace the harness. Furthermore, as noted above the golf bag support members or coupling members can be adjusted in the same way as was done for the single golf bag couplers. Thus, the crosspiece could be adjusted along the harness frame, so as to adjust the height at which the golf bags are carried. Also, since the two golf bags being carried will often vary in weight, the crosspiece could be made to rotate so as to adjust the torque produced by the uneven weight distribution coupled to the crosspiece. Alternatively, the crosspiece could be made with telescoping sections to adjust the torque produced by one side on the harness. Shoulder straps and waist straps as well as a main support member could be used as well as described herein. Furthermore, the crosspiece could be made integral to the harness frame.

It is noted that many of the structures, materials and acts recited herein can be recited as means for performing a function or steps for performing a function. Therefore, it should be understood that such language is entitled to cover all such structures, materials, or acts, disclosed within this specification and their equivalents.

It is thought that the apparatuses and methods of the embodiments of the invention will be understood from this specification and it will be apparent that various changes may be made in form, construction, and arrangement of the various embodiments described without departing from the spirit of the invention. The described embodiments are merely exemplary embodiments and should not be used to limit the claims to merely what has been disclosed as an exemplary embodiment.

What is claimed is:

1. An apparatus for use in carrying a golf bag, said apparatus comprising:

a waist belt for coupling with the waist of a user;

shoulder straps for disposing over the shoulders of the user when donning said apparatus coupled with a golf bag;

a height adjustment support member coupled with said waist belt and extending above said waist belt when said waist belt is being worn by the user so as to allow a portion of the golf bag to be positioned above said waist belt when said apparatus is being used to carry the golf bag;

a golf bag coupler configured for coupling with said height adjustment support member and further configured for coupling with the golf bag when said apparatus is being used to carry the golf bag on the user and wherein the golf bag coupler is configured to move relative to said height adjustment support member so as to allow said portion of the golf bag to be positioned at a desired height relative to the user when said apparatus is being worn by the user to carry the golf bag;

at least one stabilizer strap coupled with said waist belt and configured for positioning around the golf bag when the golf bag is being carried by the apparatus so as to reduce swing movement of the golf bag while the golf bag is being carried.

2. An apparatus for use in carrying a golf bag, said apparatus comprising:

a waist belt for coupling with the waist of a user;

a height adjustment support member comprising a slot, said height adjustment support member coupled with said waist belt so as to allow said height adjustment support member to be coupled with the user when said apparatus is being worn by the user;

a golf bag coupler configured for coupling with a golf bag and further configured for mounting along said height adjustment support member;

wherein said golf bag coupler is coupled with said height adjustment support member via at least one pin operable for selected positioning along said slot; and wherein said pin is operable to allow the user to position the golf bag in a substantially transverse position relative to the spine of the user when the apparatus is being worn about the waist of the user.

3. An apparatus for use in carrying a golf bag, said apparatus comprising:

a waist belt for coupling with the waist of a user;

a height adjustment support member comprising a slot, said height adjustment support member coupled with said waist belt so as to allow said height adjustment support member to be coupled with the user when said apparatus is being worn by the user;

a golf bag coupler configured for coupling with a golf bag and further configured for mounting along said height adjustment support member;

wherein said golf bag coupler is coupled with said height adjustment support member via at least one pin operable for selected positioning along said slot; and wherein said pin allows the golf bag coupler to at least partially rotate without altering the height at which said golf bag coupler is mounted along said height adjustment support member.

4. An apparatus for use in carrying a golf bag, said apparatus comprising:

a waist belt for coupling with the waist of a user;

a height adjustment support member comprising a slot, said height adjustment support member coupled with said waist belt so as to allow said height adjustment support member to be coupled with the user when said apparatus is being worn by the user;

a golf bag coupler configured for coupling with a golf bag and further configured for mounting along said height adjustment support member;

wherein said golf bag coupler comprises:

a right side golf bag support member; and a left side golf bag support member;

wherein said right side golf bag support member is configured to support a golf bag carried on the right side of said user and wherein said left side golf bag support member is configured to support a golf bag carried on the left side of said user when wearing said apparatus to carry two golf bags;

wherein said right side golf bag support member and said left side golf bag support member are configured as a crosspiece; and wherein said crosspiece is configured to at least partially rotate relative to said height adjustment support member.

* * * * *